US005111624A

United States Patent [19]

Shoenhair et al.

[11] Patent Number: 5,111,624

[45] Date of Patent: May 12, 1992

[54] METHOD AND APPARATUS FOR LIMITING THE DISPERSION OF RAIL GRINDING MACHINE SPARK AND DUST RESIDUE

[75] Inventors: John J. Shoenhair, New Hope; Bruce E. Kallevig, Monticello, both of Minn.

[73] Assignee: Loram Maintenance of Way, Inc., Hamel, Minn.

[21] Appl. No.: 579,891

[22] Filed: Sep. 10, 1990

[51] Int. Cl.[5] ..... E01B 31/17; B24B 55/02

[52] U.S. Cl. ..... 51/178; 51/267

[58] Field of Search ..... 51/178, 266, 267

[56] References Cited

U.S. PATENT DOCUMENTS

| | | | |
|---|---|---|---|
| 2,427,085 | 9/1947 | Allison | 51/267 |
| 2,738,625 | 3/1956 | Strnad | 51/267 |
| 2,840,960 | 7/1958 | Booth | 51/267 |
| 3,974,598 | 8/1976 | Guidry | 51/170 T |
| 4,178,724 | 12/1979 | Bruno | 51/178 |
| 4,209,950 | 7/1980 | Sielemann | 51/267 |
| 4,216,630 | 8/1980 | Smart et al. | 51/170 T |
| 4,235,052 | 11/1980 | Guidry | 51/266 |
| 4,523,411 | 6/1985 | Freerks | 51/267 |
| 4,583,327 | 4/1986 | Jaeggi | 51/178 |
| 4,693,039 | 9/1987 | Vieu et al. | 51/178 |

*Primary Examiner*—Roscoe V. Parker

*Attorney, Agent, or Firm*—Patterson & Keough

[57] ABSTRACT

A fan is passively, detachably carried by the grinding head assembly of a railroad track rail grinding machine. The fan plate is oriented above the grinding stone and rotates with the grinding stone during grinding operations. A downward draft of air is induced by the fan to limit the dispersion of sparks, grinding stone residue, and other byproducts of the grinding operation. Water, with or without a surfactant added, can be introduced into the downdraft.

15 Claims, 3 Drawing Sheets

METHOD AND APPARATUS FOR LIMITING THE DISPERSION OF RAIL GRINDING MACHINE SPARK AND DUST RESIDUE

TECHNICAL FIELD

This invention relates to machines for maintaining railroad track rails by the grinding of corrugations and other irregularities formed on the rail surface. In particular, it relates to an apparatus and method for limiting the dispersion of sparks and dust generated in the rail grinding process.

BACKGROUND ART

Railroad track rails are subject to wear by the passage of trains over the rails. In particular, depressions in the upper surface of a rail may develop such that the railhead presents a modulating, corrugated surface. Moreover, the rail may develop burrs or otherwise lose its symmetrical profile. Maintenance of smooth running surfaces on railroad track rails is important for reasons of safety, riding comfort, protection of the track, track bed and rolling stock, noise suppression, and reduced maintenance of the track and track bed.

Grinding machines have been developed for maintaining railroad track rails in smooth, properly shaped condition. Such grinding machines generally comprise a plurality of rotatable grinding modules carried by a locomotive or the like in close proximity to the railhead surfaces of the track rail. The grinding modules include rotatable, abrasive grinding stones that can be lowered into a position flush with the rail surface to grind and restore the rail surface to a smooth, desired profile.

The operation of grinding railroad track rails with abrasive stones necessarily produces sparks, metal tailings, and grinding stone residue. The sparks present a fire hazard as well as a safety hazard to personnel involved in the grinding operation. Often, the mere threat of a fire hazard in extremely dry areas may require the cessation of grinding activities, prolonging the time to accomplish necessary track maintenance and increasing maintenance costs.

A number of designs have been proposed to contain, suppress or evacuate the sparks, residue, and dust that are the byproducts of railroad rail grinding. Grinding machines have been fitted with metal flaps on the field sides of the machines in proximity to the grinding stones. Such flaps are effective in containing some of the byproducts by presenting a physical barrier. U.S. Pat. No. 4,583,327 to Jaeggi discloses a rail grinding machine wherein the grinding stones are surrounded by shrouds. A source of negative pressure is connected to the shrouds to pull dust and sparks away from the grinding area. European Patent Publication No. 0 070 359/B1 assigned to Speno International S.A. discloses a grinding machine wherein a steam mist is directed by nozzles toward the vicinity of the grinding area. U.S. patent application Ser. No. 464,127 assigned to the assignee of the present application, discloses a grinding machine wherein water is sprayed by specially designed and positioned nozzles in the vicinity of the grinding area.

The generation of dust from the rail grinding process has recently come under the scrutiny of several governmental agencies concerned with maintaining air quality standards. The governmental interest in maintaining air quality, together with the continuing hazard of fire associated with rail grinding, has caused the rail grinding industry to redouble its efforts to find effective methods and devices for controlling the byproducts of the rail grinding process.

SUMMARY OF THE INVENTION

The method and apparatus for limiting the dispersion of the byproducts of rail grinding in accordance with the present invention are designed for stand alone use or for use in combination with known byproduct control devices and techniques. The apparatus in accordance with the invention includes a fan plate comprising a circular mounting hub and a plurality of fan blades integrally carried about the circumference of the hub. The fan plate is passively, detachably carried by the grinding stone backing plate of each of a grinding machine's grinding modules. The fan plate rotates with the grinding stone backing plate such that the fan blades induce a downdraft of air in the vicinity of the grinding stone. Water, with or with out a surfactant added, is introduced above the radially inwardly of the fan plate blades, and is carried outwardly to the blades by the rotation of the grinding stone backing plate. The water is broken into a mist by the blades, and directed downwardly by the downward draft of air induced by the fan.

DETAILED DESCRIPTION OF THE DRAWINGS

Figure 1:
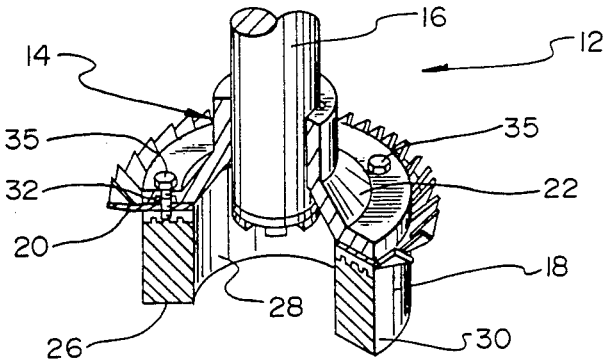
FIG. 1 is a fragmentary, perspective view of a grinding stone module having a fan plate in accordance with the present invention attached thereto.

Referring to the drawings, an apparatus 10 for limiting the dispersion of the byproducts of rail grinding operations in accordance with the present invention is depicted in conjunction with a rail grinding module 12 of a rail grinding machine. The rail grinding module 12 broadly includes a grinding head assembly 14 and a drive spindle 16 coupled to a drive motor (not shown). The grinding module 12 is supported on the grinding machine by module carriage 17. The grinding head assembly 14 includes an annular grinding stone 18, a grinding stone backing plate 20, and a backing plate holder 22. While the present invention is not limited in its application to any particular design of grinding head assembly, the particular grinding head assembly 14 depicted in the drawings is described in detail in U.S. Pat. No. 4,693,039, assigned to the assignee of the present application, said patent being incorporated by reference herein.

Briefly, the grinding stone 18 comprises a tubular shaped, molded abrasive material. The stone 18 has an annularly shaped grinding surface 26, and cylindrically shaped inner and outer sidewalls 28, 30. The backing plate 20 comprises an annular, preferably aluminum, metal ring. A plurality of generally cylindrical bosses 32 extend upwardly from the backing plate top wall surface 34. Each boss 32 receives a threaded bolt 35 extending through the backing plate holder 22 for detachably coupling the backing plate 20 to the holder 22.

The apparatus 10 includes fan plate 36 and water dispenser 38. The fan plate 36 includes a generally planar, annular central hub 40, and a plurality of fan blades 42 integrally carried along the circumferential edge of hub 40.

Figure 2:
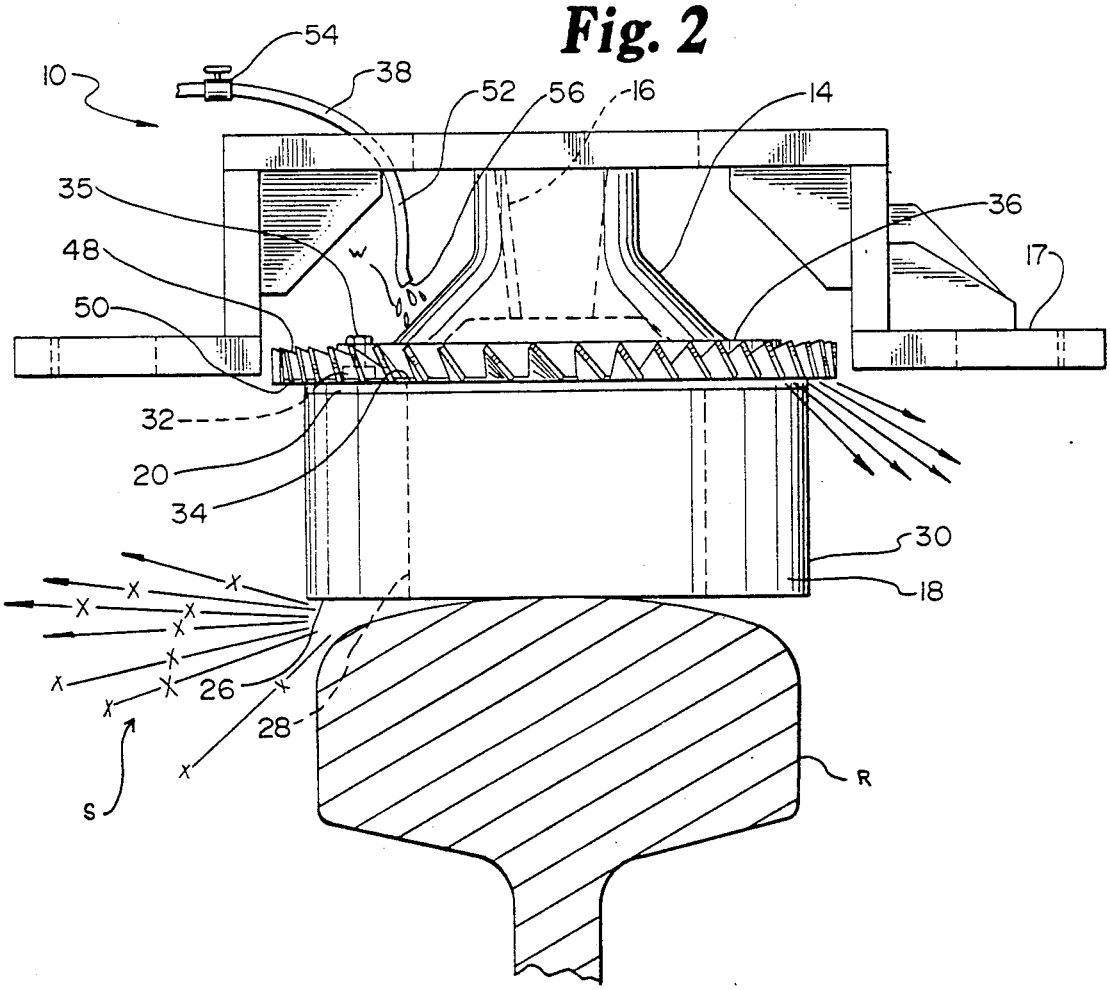
FIG. 2 is an elevational, sectional view of a grinding stone module having a fan plate and means for introducing water onto the fan plate attached thereto, the grinding stone of the grinding stone module being depicted in grinding position relative to a railroad track rail.
Figure 3:
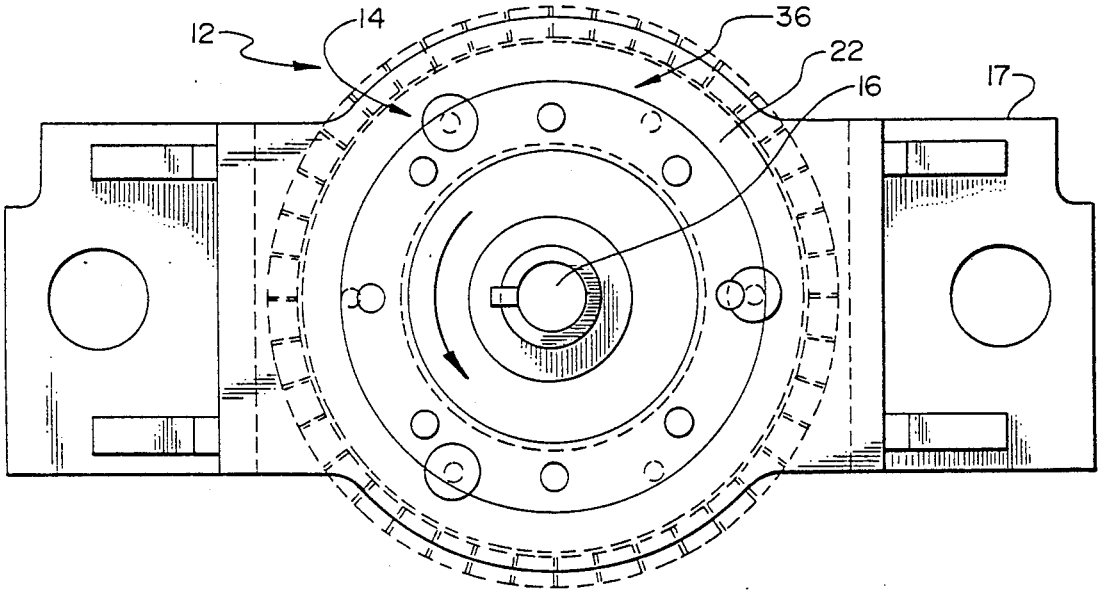
FIG. 3 is a top plan view of a grinding stone module having a fan plate in accordance with the present invention attached thereto.
Figure 4:
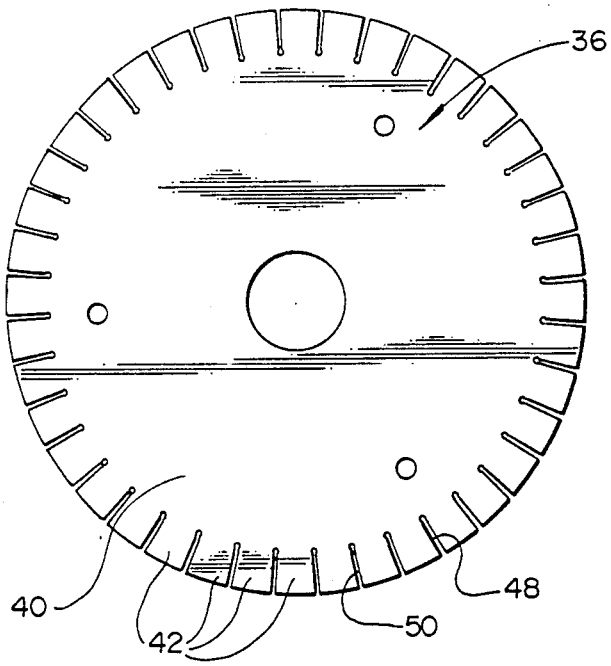
FIG. 4 is a top plan view of a fan plate in accordance with the present invention.

The fan plate hub 40 includes a central aperture 44, and a plurality of backing plate boss receiving apertures 46. Each of the blades 42 include a leading edge 48 and trailing edge 50. The leading edges 48 are canted upwardly and forwardly with respect to the trailing edges 50, and with an assumed direction of rotation as depicted in FIG. 3. Referring to FIG. 2, the fan plate is carried by the grinding head assembly 14, interposed between the top wall surface 34 of backing plate 20 and the backing plate holder 22.

Referring to FIG. 2, the water dispenser 38 comprises a water delivery tube 52 coupled in fluid communication to a water dispensing tank (not shown). A valve 54 or other suitable means for controlling the rate of flow through the tube 52 is provided. The outlet 56 of the tube 52 is positioned above the backing plate holder 22 and radially inwardly of the fan blades 42.

Figure 5:
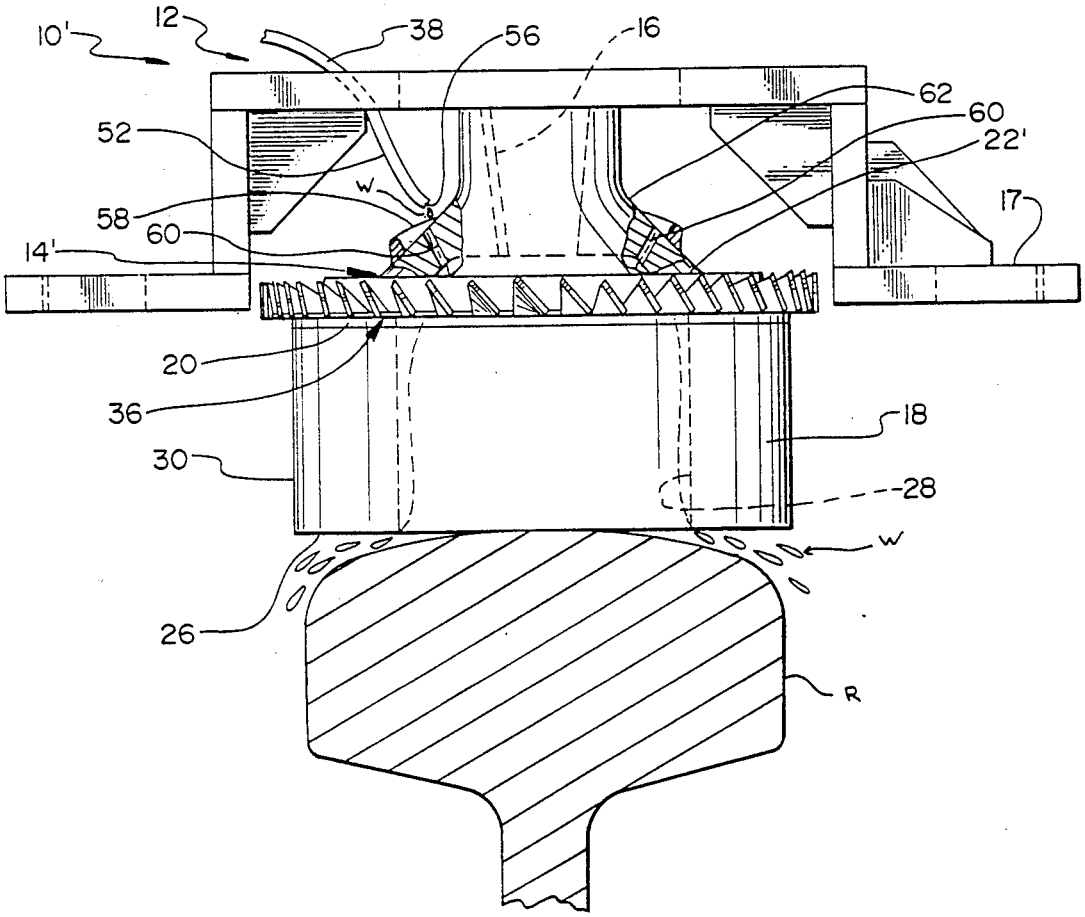
FIG. 5 is an elevational, sectional view of a grinding stone module having a fan plate and means for introducing water onto the fan plate in accordance with an alternate embodiment of the invention attached thereto configured for wet grinding of a railroad track rail.

Referring to FIG. 5, an alternate embodiment of an apparatus 10' for suppressing the byproducts of rail grinding is depicted. The apparatus 10' and grinding head assembly 14' are in most respects similar to those described above in conjunction with the first embodiment of the invention, and similar elements are annotated with similar numerals. The backing plate holder 22' of the grinding head assembly 14', however, includes upwardly extending annular ridge 58, and a plurality of water carrying channels 60 extending from the upper surface 62 of the backing plate holder 22' into the interior 64 of the backing plate holder.

In operation, the fan plate 36 is carried by the grinding head assembly 14 between the grinding stone backing plate 20 and the backing plate holder 22. The bosses 32 are received through the apertures 46 for positive rotation of the fan plate 36 with the backing plate 20 and stone 18. Rotation of the stone 18 in engagement with the rail R of a railroad track causes a stream S of sparks, grinding stone residue, metal tailings, and other byproducts of the grinding process to be directed outwardly from the rail R. At the same time, rotation of the fan plate 36 causes air to be engaged by the fan blades 42 and directed downwardly around the stone 18 so as to intercept and direct downwardly the stream of byproducts S.

Water W, or some other suitable liquid, is dripped or sprayed on to the upper surface of backing plate holder 22, and directed outwardly along the surface of the backing plate holder by the rotation of the grinding head assembly 14. The water W contacts the fan blades 42, is broken into a mist, and is mixed in to the stream of air S being induced by the fan blades 42. The water W, with or without a surfactant added, cools and settles the airbone particulates comprising the grinding residue. Referring to the alternate embodiment of FIG. 6, the water W may alternatively be collected by annular ridge 58 and directed downwardly through channels 60 into the interior of grinding stone 18.

We claim:

1. In a rail grinding machine having a grinding module with a rotatable grinding stone carried by a grinding head assembly for grinding contact of said grinding stone with a railroad track rail, the contact of said grinding stone with said rail generating a stream of airborn rail grinding byproducts, the improvement comprising:

fan means operably carried by said grinding head assembly for inducing a downdraft about said stone whereby the downdraft intercepts said stream of airborn rail grinding byproducts and limits the dispersion of said airborn byproducts into the atmosphere, said grinding stone comprising a generally annular stone having a grinding surface, an opposed upper surface, and a generally cylindrical outer sidewall extending between said grinding surface and said upper surface and defining an outer stone diameter, said fan means including a plurality of fan blades oriented above said grinding surface and extending beyond said outer stone diameter.

2. The invention as claimed in claim 1, said fan means including a central hub adapted for detachable coupling to said grinding head assembly, said plurality of blades being integrally carried by said hub along the circumferential perimeter thereof.

3. The invention as claimed in claim 1, including means for introducing a liquid into said downdraft.

4. The invention as claimed in claim 3, said means for introducing a liquid into said downdraft comprising conduit means having on outlet oriented above said fan means whereby liquid exiting said outlet is directed into said fan blades.

5. The invention as claimed in claim 3, said grinding stone comprising a generally tubular stone having an annular grinding surface, an opposed upper surface, and an internal sidewall defining an internal stone cavity, said means for introducing liquid into said downdraft including means for introducing water into said internal stone cavity.

6. An apparatus for limiting the dispersion of airborn byproducts generated by the contact of a rotating grinding stone with a railroad track rail comprising fan means operably coupled to said grinding stone for rotation with said stone whereby a curtain of air induced by said fan means surrounds said stone and intercepts said byproducts, said grinding stone comprising a generally annular stone having a grinding surface, an opposed upper surface, and a generally cylindrical outer sidewall extending between said grinding surface and said upper surface and defining an outer stone diameter, said fan means including a plurality of fan blades oriented above said grinding surface and extending beyond said outer stone diameter.

7. The invention as claimed in claim 6, said fan means including a central hub adapted for detachable coupling to said grinding head assembly, said plurality of blades being integrally carried by said hub along the circumferential perimeter thereof.

8. The invention as claimed in claim 6, including means for introducing a liquid into said downdraft.

9. The invention as claimed in claim 8, said means for introducing a liquid into said downdraft comprising conduit means having on outlet oriented above said fan means whereby liquid exiting said outlet is directed into said fan blades.

10. The invention as claimed in claim 8, said grinding stone comprising a generally tubular stone having an annular grinding surface, an opposed upper surface. and an internal sidewall defining an internal stone cavity, said means for introducing liquid into said downdraft including means for introducing water into said internal stone cavity.

11. A grinding machine for grinding the rails of a railroad track, said grinding machine including a plurality of grinding modules having grinding stones operably coupled to grinding motors by grinding head assemblies for rotation of said stones, each of said grinding head assemblies including fan means for rotation of said fan means with said stones whereby a curtain of air is induced by each of said fan means to surround its respective stone, each of said grinding stones comprising a generally annular stone having a grinding surface, an opposed upper surface, and a generally cylindrical outer sidewall extending between said grinding surface and said upper surface and defining an outer stone diameter, each of said fan means including a plurality of fan blades oriented above the grinding surface of its respective stone, said fan blades extending beyond said outer stone diameter.

12. The invention as claimed in claim 11, each of said fan means including a central hub adapted for detachable coupling to its respective grinding head assembly, said plurality of blades being integrally carried by said hub along the circumferential perimeter thereof.

13. The invention as claimed in claim 11, including means for introducing a liquid into said downdrafts.

14. The invention as claimed in claim 13, said means for introducing a liquid into said downdrafts comprising conduit means having on outlet oriented above each of said fan means whereby liquid exiting said outlet is directed into said fan blades.

15. The invention as claimed in claim 11, said grinding stones each comprising a generally tubular stone having an annular grinding surface, an opposed upper surface, and an internal sidewall defining an internal stone cavity, said means for introducing liquid into said downdraft including means for introducing water into said internal stone cavity.

* * * * *

UNITED STATES PATENT AND TRADEMARK OFFICE

CERTIFICATE OF CORRECTION

PATENT NO. : 5,111,624

DATED : May 12, 1992

INVENTOR(S) : John J. Shoenhair and Bruce E. Kallevig

It is certified that error appears in the above-identified patent and that said Letters Patent is hereby corrected as shown below:

Column 2, line 18, delete the words "with out" and substitute therefor --without--.

Column 2, line 19, delete the words "above the radially" and substitute therefor --above and radially--.

Column 6, line 13, delete the word "on" and substitute therefor --an--.

Column 6, lines 18-19, delete the words "an opposed upper surface,".

Signed and Sealed this

Twelfth Day of October, 1993

Bruce Lehman

*Attest:*

BRUCE LEHMAN

*Attesting Officer*

*Commissioner of Patents and Trademarks*